US008727719B2

(12) United States Patent
Belmonte et al.

(10) Patent No.: US 8,727,719 B2
(45) Date of Patent: May 20, 2014

(54) ANNULAR FLANGE FOR FASTENING A ROTOR OR STATOR ELEMENT IN A TURBOMACHINE

(75) Inventors: Olivier Belmonte, Perthes en Gatinais (FR); Thomas Langevin, Brunoy (FR); Stevan Le Goff, Vaux le Penil (FR)

(73) Assignee: SNECMA, Paris (FR)

( * ) Notice: Subject to any disclaimer, the term of this patent is extended or adjusted under 35 U.S.C. 154(b) by 329 days.

(21) Appl. No.: 13/127,836

(22) PCT Filed: Sep. 29, 2009

(86) PCT No.: PCT/FR2009/001164

§ 371 (c)(1),
(2), (4) Date: Jul. 18, 2011

(87) PCT Pub. No.: WO2010/052379

PCT Pub. Date: May 14, 2010

(65) Prior Publication Data

US 2011/0274541 A1 Nov. 10, 2011

(30) Foreign Application Priority Data

Nov. 7, 2008 (FR) ..... 08 06241

(51) Int. Cl.
*F01D 25/28* (2006.01)

(52) U.S. Cl.
USPC ..... 415/209.2

(58) Field of Classification Search
USPC ..... 415/209.2
See application file for complete search history.

(56) References Cited

U.S. PATENT DOCUMENTS

| | | | | |
|---|---|---|---|---|
| 6,893,222 | B2 * | 5/2005 | Allam | 416/144 |
| 2004/0037641 | A1 | 2/2004 | Wagner | |
| 2004/0156708 | A1 | 8/2004 | Allam | |
| 2005/0246889 | A1 | 11/2005 | Charrier et al. | |
| 2007/0014631 | A1 | 1/2007 | Wagner | |
| 2007/0059164 | A1 * | 3/2007 | Brault et al. | 415/174.5 |
| 2011/0097206 | A1 | 4/2011 | Belmonte et al. | |

FOREIGN PATENT DOCUMENTS

| | | |
|---|---|---|
| EP | 1 380 759 | 1/2004 |
| EP | 1 445 422 | 8/2004 |
| EP | 1 584 784 | 10/2005 |
| EP | 1 717 415 | 11/2006 |

OTHER PUBLICATIONS

International Search Report issued Feb. 5, 2010 in PCT/FR09/001164 filed Sep. 29, 2009.

* cited by examiner

*Primary Examiner* — Nathaniel Wiehe
*Assistant Examiner* — Brian O Peters
(74) *Attorney, Agent, or Firm* — Oblon, Spivak, McClelland, Maier & Neustadt, L.L.P.

(57) ABSTRACT

A radial annular flange including in inner or outer periphery alternating solid portions including orifices for passing fastener bolts, and hollow portions having bottoms that are substantially flat. The bottom of at least one keying hollow portion is situated radially inside, or outside, respectively, a circle centered on the axis of the flange and externally, or respectively internally, tangential to the orifices. Two hollow portions are situated on either side of the keying hollow portion having bottoms of concave curved shapes situated radially on the outside, or respectively on the inside, relative to the flat bottoms of the other hollow portions.

11 Claims, 2 Drawing Sheets

ANNULAR FLANGE FOR FASTENING A ROTOR OR STATOR ELEMENT IN A TURBOMACHINE

BACKGROUND OF THE INVENTION

1. Field of the Invention

The invention relates to annular flanges for fastening rotor or stator elements in a turbine, and also to a turbomachine including such a turbine.

2. Description of the Related Art

In a turbomachine the rotor disks (e.g. turbine disks) are connected together by annular flanges at their radially inner peripheries, those flanges pressing against one another and being fastened together by bolting.

Other elements, such as annular supports for labyrinth seals, may also include annular flanges at their inner peripheries, which flanges are clamped between two annular rotor disk flanges and fastened by the same bolts as the rotor disks.

Such annular flanges are generally festooned, i.e. they have alternating solid portions and hollow portions so as to reduce their weight. The holes for passing the fastener bolts are formed through the solid portions.

In order to fasten together a plurality of juxtaposed flanges, it is necessary for all of the holes formed through the solid portions of the flange to be in alignment so as to avoid the hollow portions of one of the flanges being angularly offset so as to be in alignment with the bolt-passing holes formed in the solid portions of other flanges, which would lead to that flange being clamped between two other flanges without being fastened to the other flanges.

In the Applicants' application FR 08/02918, proposals are made for at least one bottom of a hollow portion in the inner periphery to be situated radially inside a circle centered on the axis of the flange and to be externally tangential to the orifices in the solid portions. Thus, in the event of a flange being angularly offset in such a manner that its orifices are not in alignment with the orifices in the other flanges, then the bottom of at least one of the hollow portions of said flange is situated on the path of at least one fastener bolt and prevents it from being inserted through the orifices of the other flanges, thereby avoiding any risk of the flange being wrongly assembled.

It has been found that such a hollow portion performing a keying function gives rise to a modification to the tangential stress lines in the flange, thereby leading to an increase in stress concentration in the solid portions adjacent to the keying hollow portion. Those stresses are at a maximum in those zones of the solid portions adjacent to the keying hollow portion that are connected to the following hollow portions. It is also observed that stresses are increased in the orifices of the solid portions adjacent to the keying hollow portion.

Such an increase in local stress concentration may lead to the formation of cracks in the zones where stresses are concentrated, thereby limiting the lifetime of the festooned flange.

BRIEF SUMMARY OF THE INVENTION

A particular object of the invention is to provide a solution to that problem that is simple, inexpensive, and effective.

To this end, the invention provides a radial annular flange of a rotor or stator element of a turbomachine turbine, the flange including in an inner periphery (or respectively in an outer periphery) alternating solid portions and hollow portions, the solid portions including orifices for passing fastener bolts, the bottoms of the hollow portions being substantially flat and the bottom of at least one keying hollow portion of the inner periphery (or outer periphery, respectively) being situated radially on the inside (or on the outside, respectively) of a circle centered on the axis of the flange and externally (or respectively internally) tangential to the orifices in the solid portions, the flange being characterized in that the two hollow portions situated on either side of the keying hollow portion present bottoms of concave curved shapes situated radially on the outside (or on the inside, respectively) relative to the bottoms of the other hollow portions.

Providing bottoms of concave curved shapes instead of flat bottoms on either side of the keying hollow portion and positioning these bottoms of concave curved shapes radially outside (or respectively inside) relative to the flat bottoms of the other hollow portions, enables tangential stresses to be spread over the length of each concave curved bottom.

The invention thus avoids increasing tangential stresses at the edges of the orifices in the solid portions adjacent to the keying hollow portion and also in the zones connecting said adjacent solid portions to the concave curved hollow portions.

The concave curved bottoms of the two hollow portions are preferably in the form of circular arcs of radius R2.

According to another feature of the invention, the concave curved bottoms of the two hollow portions are connected to the adjacent solid portions by circular arcs of radius R1, with the radius R2 of the concave curved bottoms of said two hollow portions being greater than or equal to three times the radius R1 of the connections of the adjacent solid portions.

Advantageously, the radius R2 of the concave curved bottoms of said two hollow portions is greater than the radius R1 of the connections to the adjacent solid portions.

The radius R1 of the connections may lie in the range 4 millimeters (mm) to 6 mm and the concave curved bottoms of said two hollow portions may have a radius of the order of 18 mm.

The invention also provides a low pressure turbine for a turbomachine, the turbine being characterized in that it includes at least one annular flange as described above.

The invention also provides a turbomachine, such as a turbojet or a turboprop, the turbomachine being characterized in that it includes a low pressure turbine of the above-described type.

BRIEF DESCRIPTION OF THE SEVERAL VIEWS OF THE DRAWINGS

The invention can be better understood and other details, advantages, and characteristics of the invention appear on reading the following description made by way of non-limiting example and with reference to the accompanying drawings, in which.

DETAILED DESCRIPTION OF THE INVENTION

Figure 1:
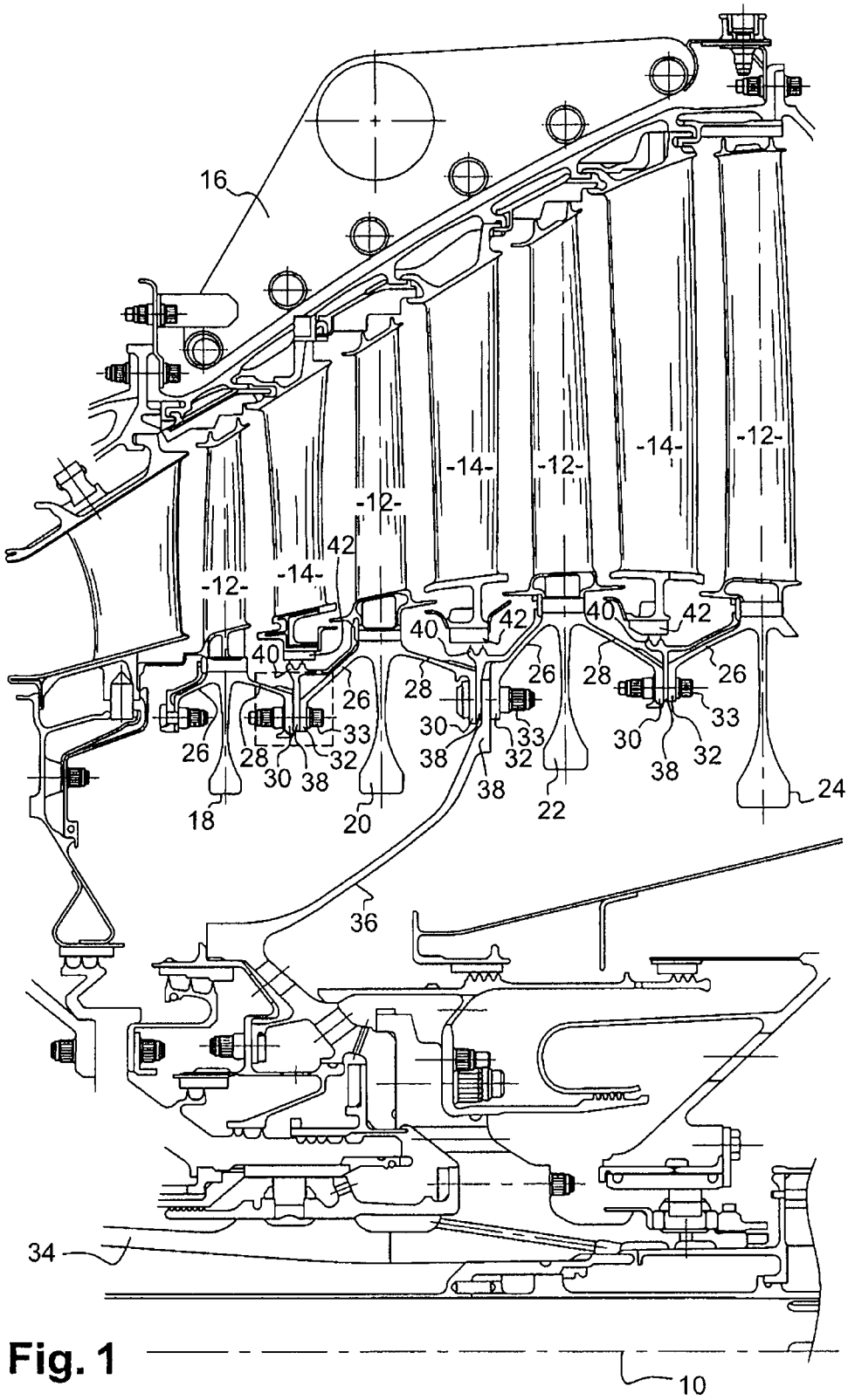
FIG. 1 is a fragmentary diagrammatic half-view in axial section of a low pressure turbine.

Reference is made initially to FIG. 1, which shows a low pressure turbine rotor of axis 10 comprising alternating moving blades 12 and stationary vanes 14 housed in an outer casing 16. The radially inner ends of the moving blades 12 are fastened to the outer peripheries of rotor disks 18, 20, 22, 24. Each disk 18, 20, 22, 24 has upstream and downstream frustoconical walls 26 and 28 at its outer periphery connecting with the other disk by means of annular flanges 30, 32 that extend radially inwards and that are fastened to one another by bolts 33. The set of disks is connected to a turbine shaft 34 via a drive cone 36 including an annular flange 38 clamped between the annular flanges 30, 32 of the disks 20 and 22.

In order to avoid unwanted air flow between the inner periphery of a row of stationary vanes 14 and the downstream and upstream frustoconical walls 28 and 26 of the disks, a radial annular flange 38 carrying a labyrinth seal 40 on its outer periphery is interposed between the radial flanges 30, 32 of the upstream and downstream frustoconical walls 28 and 26 of the disks, the labyrinth seal 40 co-operating with a track of abradable material 42 mounted on the inner periphery of a row of stationary vanes 14.

Figure 2:
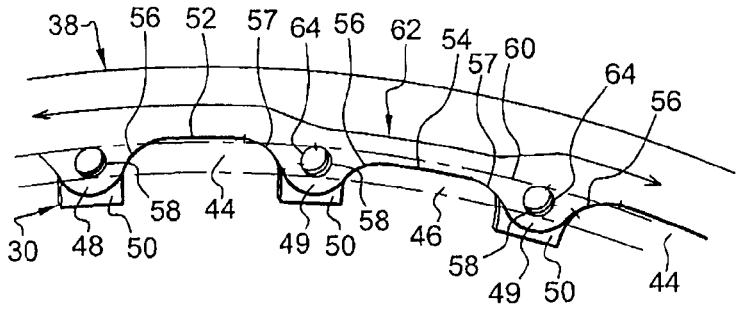
FIG. 2 is a fragmentary diagrammatic face view of a radial annular flange including a hollow keying portion in accordance with the prior art, illustrating correct angular positioning.

The radial annular flanges 30, 32 of the upstream and downstream frustoconical walls 26 and 28 and the radial flange 38 of a labyrinth seal 40 are festooned in order to reduce their weight, and they comprise alternating hollow portions and solid portions. FIG. 2 shows a radial annular flange 30 of an upstream frustoconical wall assembled with a radial flange 38 of a labyrinth seal, the hollow portions 44, 46 and the solid portions 48, 49, 50 of the flange 38 of the labyrinth seal and of the radial annular flange 30 respectively being in axial alignment.

The hollow portions 44, 46 of the radial flange 38 have substantially flat bottoms 52, 54 and are connected to the solid portions 48, 49 via curved zones 56, 57. The solid portions 48, 49 have a rounded shape and include orifices 58 for receiving fastener bolts enabling the annular flanges 30 and 32 of the upstream and downstream frustoconical walls and the annular flange 38 of the labyrinth seal to be fastened together.

Proper positioning of the flange 38 of the labyrinth seal between the annular flanges 30, 32 of the frustoconical walls is ensured by the fact that the bottom 54 of at least one hollow portion 46 of the flange 38 of the labyrinth seal is situated radially inside a circle 60 centered on the axis of the flange 38 and externally tangential to the orifices 58 in the solid portions (FIG. 2).

Thus, when assembling the flange 38 of the labyrinth seal between the two annular flanges 30, 32 of the frustoconical walls with an annular offset such that the hollow portions 44, 46 are in axial alignment with the solid portions 50 of the annular flanges 30, 32 of the frustoconical walls, the bottom 54 of the hollow portion 46 is situated on the path of a bolt, thereby making it impossible to insert fastener bolts in the orifices 58 of the solid portions of the annular flanges of the frustoconical walls.

Nevertheless, incorporating a keying hollow portion 46 gives rise to a change in the lines of tangential stress 62 in the radial flange 38 of the labyrinth seal. Because the bottom 54 of at least one hollow portion 46 is offset radially inwards, the tangential stress lines 62 are also offset radially inwards in the vicinity of the keying hollow portion 46.

This modification to the stress lines leads to an increase of stresses in the solid portions 49 adjacent to the keying hollow portion 46. Stresses are at a maximum in the connection zones 57 between the solid portions 49 and the hollow portions 44 situated on either side of the keying hollow portion 46. An increase in tangential stresses is also observed in the portions 64 of the edges of the orifices 58 in the adjacent solid portions 49 that are situated circumferentially in register with the above-mentioned connection zones 57 where stresses are at a maximum.

This modification to stress lines can give rise to the formation of cracks and can thus have a harmful effect on the mechanical behavior of the flange in operation.

Figure 3:
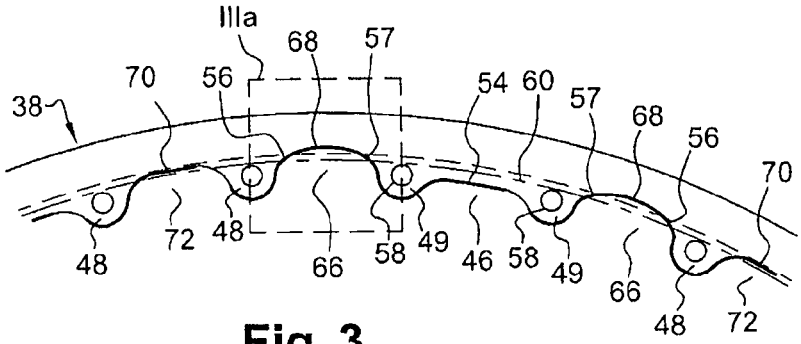
FIG. 3 is a fragmentary diagrammatic face view of a radial annular flange of the invention.
Figure 3A:
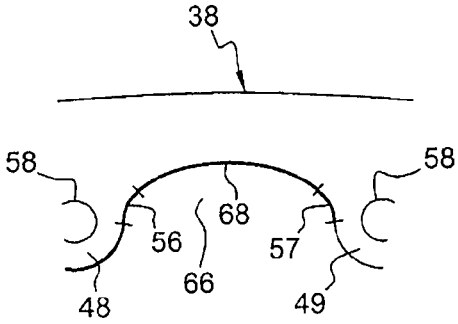
FIG. 3*a* is an enlarged view of detail IIIa of FIG. 3.

According to the invention, those drawbacks are avoided by the fact that the two hollow portions 66 situated on either side of the keying hollow portion 46 have bottoms 68 of concave curved shape situated radially on the outside relative to the bottoms 70 of the other hollow portions 72 (FIG. 3).

The tangential stresses are thus spread over the lengths of the concave curved bottoms 68 of the hollow portions 66 situated on either side of the keying hollow portion 46, thereby avoiding any increase in the stresses in the zones 57 connecting the concave curved bottoms 68 to the solid portions 49 adjacent to the keying hollow portion 46. The level of stress is also diminished beside the orifices 58 of these adjacent solid portions 49.

Figure 4:
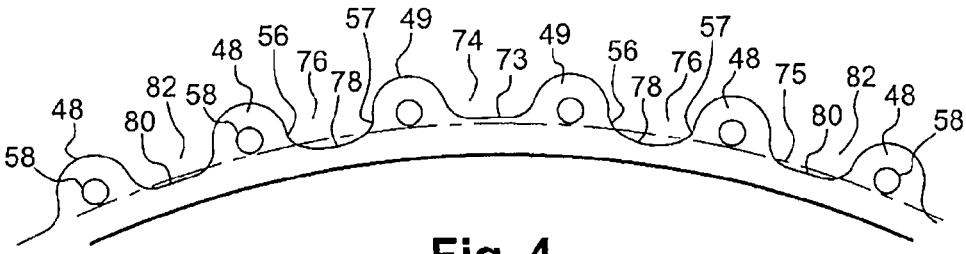
FIG. 4 is a fragmentary diagrammatic face view of another embodiment of a radial annular flange of the invention.

In a variant embodiment of the invention as shown in FIG. 4, the festooning is performed in the outer periphery of the annular flange. Under such circumstances, the keying hollow portion 74 has a flat bottom 73 that is situated radially outside a circle 75 centered on the axis of the flange and internally tangential to the orifices 58 in the solid portions 48, 49. The hollow portions 76 situated on either side of the keying hollow portion 74 have bottoms 78 of concave curved shapes situated radially on the inside relative to the flat bottoms 80 of the other hollow portions 82.

The concave curved bottoms 68, 78 of the inner or outer periphery are circular arcs of radius R2 connected to the adjacent solid portions 48, 49 by circular arcs 56, 57 of radius R1 that is less than the radius R2 of the concave curved bottoms.

The radius R2 of the concave curved bottoms 68, 78 is greater than or equal to three times the radius R1 of the circular arc 56, 57 connecting to the adjacent solid portions 48, 49.

The radius R1 may lie in the range 4 mm to 6 mm.

In another variant of the invention, the annular flange 38 includes at least one keying hollow portion 46, 74 in its inner or outer periphery, and all of the other hollow portions 72, 82 have concave curved bottoms 68, 78, as described above.

In a particular embodiment of the invention, in which the festooning is performed in the outer periphery of the annular flange, the distance between the centers of two diametrically-opposite orifices 58 is 530 mm. The concave curved bottoms 78 extend over an arcuate distance of about 15 mm and present a radius R2 of the order of 18 mm.

The concave curved bottoms 68, 78 as described above may be made in simple manner on flanges that already have a keying hollow portion 46, 74, since it then suffices merely to perform additional machining in the hollow portions 66, 76 situated on either side of the keying hollow portion 46, 74.

The invention claimed is:

1. A radial annular flange of a turbomachine turbine, the flange having an axis around which axis the flange extends and comprising: at an inner periphery, alternating solid portions and hollow portions, the solid portions including orifices for passing fastener bolts, the hollow portions comprising a first hollow portion, a second hollow portion, and third hollow portions, each of the hollow portions having a bottom, the bottoms of first and second hollow portions being substantially flat, wherein the second hollow portion comprises a keying system formed by its flat bottom that is situated radially on the inside of a circle centered on the axis of the flange and externally tangential to the orifices in the solid portions, wherein the third hollow portions are situated on either side of said second hollow portion and present bottoms of concave curved shapes situated radially on the outside relative to the bottoms of the first and second hollow portions, and wherein the bottom of the first hollow portion is situated radially on the outside relative to the circle externally tangential to the orifices of the solid portions.

2. A radial annular flange of a turbomachine turbine, the flange having an axis around which axis the flange extends and comprising: at an outer periphery, alternating solid portions and hollow portions, the solid portions including orifices for passing fastener bolts, the hollow portions comprising a first hollow portion, a second hollow portion, and third hollow portions, each of the hollow portions having a bottom, the bottoms of first and second hollow portions being substantially flat, wherein the second hollow portion comprises a keying system formed by its flat bottom that is situated radially on the outside of a circle centered on the axis of the flange and internally tangential to the orifices in the solid portions, wherein the third hollow portions are situated on either side of said second hollow portion and present bottoms of concave curved shapes situated radially on the inside relative to the bottoms of the first and second hollow portions.

3. A flange according to claim 2, wherein the bottom of the first hollow portion is situated radially on the inside relative to the circle internally tangential to the orifices of the solid portions.

4. A flange according to claim 1 or claim 3, wherein the concave curved bottoms of the third hollow portions are in a form of circular arcs of radius R2.

5. A flange according to claim 4, wherein the concave curved bottoms of the third hollow portions are connected to the adjacent solid portions by circular arcs of radius R1.

6. A flange according to claim 5, wherein the radius R2 of the concave curved bottoms of the third hollow portions is greater than the radius R1 of the connections to the adjacent solid portions.

7. A flange according to claim 6, wherein the radius R2 of the concave curved bottoms of the third hollow portions is greater than or equal to three times the radius R1 of the connections of the adjacent solid portions.

8. A flange according to claim 5, wherein the radius R1 of the connections is in a range of 4 mm to 6 mm.

9. A flange according to claim 4, wherein the concave curved bottoms of the third hollow portions have a radius of about 18 mm.

10. A low pressure turbine for a turbomachine, the turbine comprising at least one annular flange according to claim 1 or claim 2.

11. A turbomachine, a turbojet, or a turboprop, comprising a low pressure turbine according to claim 10.

* * * * *